US005255415A

United States Patent [19]

Leifeld et al.

[11] Patent Number: 5,255,415

[45] Date of Patent: Oct. 26, 1993

[54] INTEGRAL COMMON DUCT WITH SUCTION HOODS FOR WASTE REMOVAL

[75] Inventors: Ferdinand Leifeld, Kempen; Konrad Temburg, Mönchengladbach, both of Fed. Rep. of Germany

[73] Assignee: Trützschler GmbH & Co. KG, Mönchengladbach, Fed. Rep. of Germany

[21] Appl. No.: 760,892

[22] Filed: Sep. 17, 1991

[30] Foreign Application Priority Data

Sep. 17, 1990 [DE] Fed. Rep. of Germany ..... 4029414

[51] Int. Cl.[5] ..... D01G 15/76; D01G 9/06

[52] U.S. Cl. ..... 19/107

[58] Field of Search ..... 19/95, 98, 107, 109, 19/200, 202, 205, 100, 104; 15/256.51, 300.1

[56] References Cited

U.S. PATENT DOCUMENTS

| | | | |
|---|---|---|---|
| 2,284,750 | 6/1942 | Landreth | 19/107 |
| 3,315,320 | 4/1967 | Bass, Jr. et al. | 19/107 |
| 3,403,424 | 10/1968 | Lee | 19/107 |
| 3,483,598 | 12/1969 | Bryan, Jr. | 19/107 X |
| 3,614,813 | 10/1971 | Sloan | 19/107 |
| 3,678,538 | 7/1972 | Sloan | 19/107 |
| 3,707,020 | 12/1972 | Stewart | 19/107 |
| 3,737,952 | 6/1973 | O'Neal et al. | 19/107 |
| 3,849,837 | 11/1974 | Bass, Jr. et al. | 19/107 |
| 3,955,244 | 5/1976 | Jenkins, Jr. | 19/107 |
| 4,092,764 | 6/1978 | Thomas et al. | 19/107 |
| 4,227,285 | 10/1980 | Hamrick | 19/107 |
| 4,241,475 | 12/1980 | Miller | 19/107 X |
| 4,524,492 | 6/1985 | Elliott | 19/107 |
| 4,527,307 | 7/1985 | Teichmann | 19/107 X |
| 5,033,165 | 7/1991 | Temburg et al. | 19/107 |

FOREIGN PATENT DOCUMENTS

| | | | |
|---|---|---|---|
| 46248 | 2/1911 | Austria . | |
| 0340458 | 11/1989 | European Pat. Off. . | |
| 2833413 | 2/1979 | Fed. Rep. of Germany . | |
| 3902202 | 8/1990 | Fed. Rep. of Germany . | |
| 0350583 | 1/1961 | Switzerland | 19/107 |
| 0931907 | 7/1963 | United Kingdom | 19/107 |
| 1019767 | 2/1966 | United Kingdom | 19/107 |
| 1074127 | 6/1967 | United Kingdom | 19/107 |
| 1138220 | 12/1968 | United Kingdom | 19/107 |
| 2228018 | 8/1990 | United Kingdom | 19/107 |

*Primary Examiner*—Clifford D. Crowder
*Assistant Examiner*—Ismael Izaguirre
*Attorney, Agent, or Firm*—Spencer, Frank & Schneider

[57] ABSTRACT

A fiber processing machine includes a clothed roll arrangement for entraining fiber along a circular path; a housing surrounding the roll arrangement; at least two waste discharge openings; a separate mote knife bounding each waste discharge opening; a suction hood adjoining each waste discharge opening for receiving waste passing through the respective waste discharge opening; a separate suction conduit coupled to the respective suction hoods for receiving the waste therefrom; and a common suction duct coupled to each suction conduit for receiving the waste therefrom. The suction conduits and the common suction duct is a one-piece construction.

16 Claims, 4 Drawing Sheets

INTEGRAL COMMON DUCT WITH SUCTION HOODS FOR WASTE REMOVAL

CROSS REFERENCE TO RELATED APPLICATION

This application claims the priority of German Application No. P 40 29 414.5 filed Sep. 17, 1990, which is incorporated herein by reference.

BACKGROUND OF THE INVENTION

1. Field of the Invention

This invention relates to a device for removing waste from fiber entrained by a roller assembly in a fiber processing machine, such as a card or a fiber cleaner, for treating cotton fibers. The roll assembly has a clothed roll surrounded by a housing which has at least one waste discharge aperture for the removal of waste such as trash particles, leaf fragments, seed shells, stem fragments, sand or the like. Each waste discharge aperture is bounded by a mote knife having a knife edge oriented opposite to the direction of rotation of the clothed roll. Further, a suction device is associated with each waste discharge aperture for pneumatically removing the waste passing through the aperture.

2. Background Art

In a known apparatus of the above-outlined type there are provided a plurality of flexible hoses each having one end coupled to a suction hood and another end coupled to a suction box. At each end, the flexible hoses have a tubular nipple with a clamping strap which is structurally complex, given the great number of individual components. It is a further disadvantage of this arrangement that the installation is complicated since each hose has to be installed separately. Further, the movable hoses have to be provided with additional guiding and spacing devices to prevent—for example, in case of air flow fluctuations, vibrations or the like—a contact with the rapidly rotating drive assemblies. Thus, viewed as a whole the known apparatus is complicated to install and is of complex construction.

SUMMARY OF THE INVENTION

It is an object of the invention to provide an improved apparatus of the above-outlined type from which the discussed disadvantages are eliminated and which, in particular, is structurally simple and is easy to instal.

This object and others to become apparent as the specification progresses, are accomplished by the invention, according to which, briefly stated, the fiber processing machine includes a clothed roll arrangement for entraining fiber along a circular path; a housing surrounding the roll arrangement; at least two waste discharge openings; a separate mote knife bounding each waste discharge opening; a suction hood adjoining each waste discharge opening for receiving waste passing through the respective waste discharge opening; a separate suction conduit coupled to the respective suction hoods for receiving the waste therefrom; and a common suction duct coupled to each suction conduit for receiving the waste therefrom. The suction conduits and the common suction duct is a one-piece construction.

By virtue of the fact that a plurality of suction conduits are coupled to a common suction duct and that the several suction conduits and the common suction duct are made as a one-piece construction, there is provided but a single structural component which constitutes a significant simplification of the conduit structure and its installation. As a rule, the apparatus according to the invention may be mounted on the outlets of the suction hoods from the side.

DESCRIPTION OF THE PREFERRED EMBODIMENT

Figure 1A:
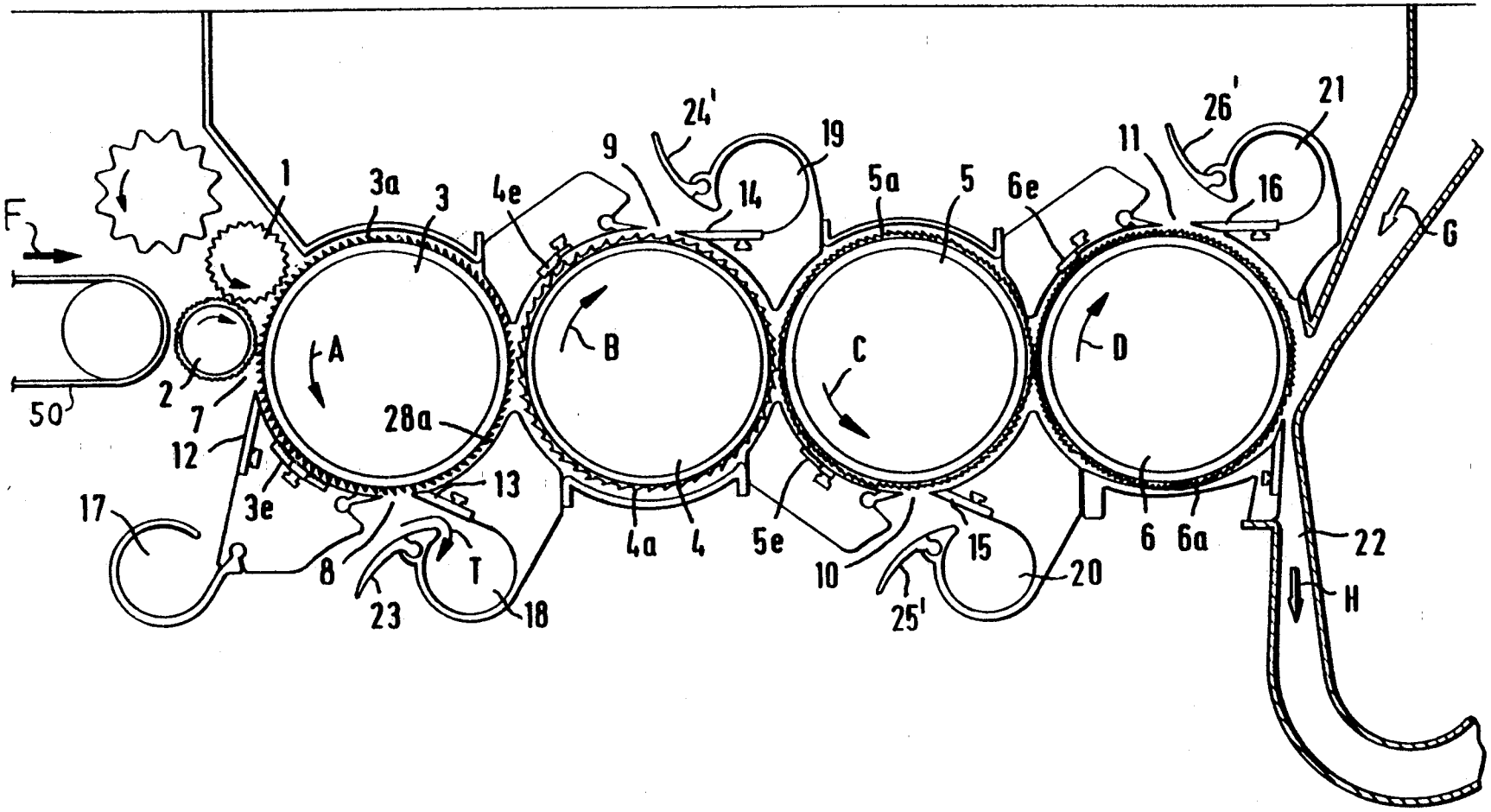
FIG. 1*a* is a schematic side elevational view of a fiber cleaning apparatus adapted to incorporate the invention.

Turning to FIG. 1*a*, there is illustrated therein a fiber cleaning device which is accommodated in a closed housing and which receives the fiber material to be cleaned, particularly cotton, as a fiber tuft mass symbolized by the arrow F. Such a feed is effected, for example, by a non-illustrated feed chute which deposits the fiber tufts on a conveyor belt 50. The fiber tuft mass (fiber lap) is advanced through the clamping nip of two feed rolls 1, 2 to a clothed roll 3 (pin roll) which is supported in the housing and which rotates counterclockwise as designated by the arrow A. The pin roll 3 is followed by a further clothed roll 4 which has a sawtooth clothing on its surface and which is rotated in the direction B. The roll 3 has a circumferential speed of approximately 10–21 m/sec, while the roll 4 has a circumferential speed of approximately 15–25 m/sec. The rolls 3 and 4 are followed by two further sawtooth rolls 5 and 6 whose direction of rotation is designated at C and D, respectively. The rolls 3, 4, 5 and 6 have a diameter of approximately 150–300 mm.

The housing portion surrounding the pin roll 3 is provided with a waste discharge opening 7 for the fiber waste; its size is adapted or adaptable to the degree of soiling of the textile fiber to be treated. The waste discharge opening 7 is bounded by a mote knife 12. Downstream of the waste discharge opening 7—as viewed in the direction of rotation of the roll 3—there is provided an additional waste discharge opening 8 bounded by a mote knife 13. The sawtooth roll 4 is associated with a waste discharge opening 9 and a mote knife 14; the sawtooth roll 5 is associated with a waste discharge opening 10 and a mote knife 15 and the sawtooth roll 6 is associated with a waste discharge opening 11 and a mote knife 16. With each mote knife 12–16 there is associated a respective suction hood 17–21.

Figure 1B:
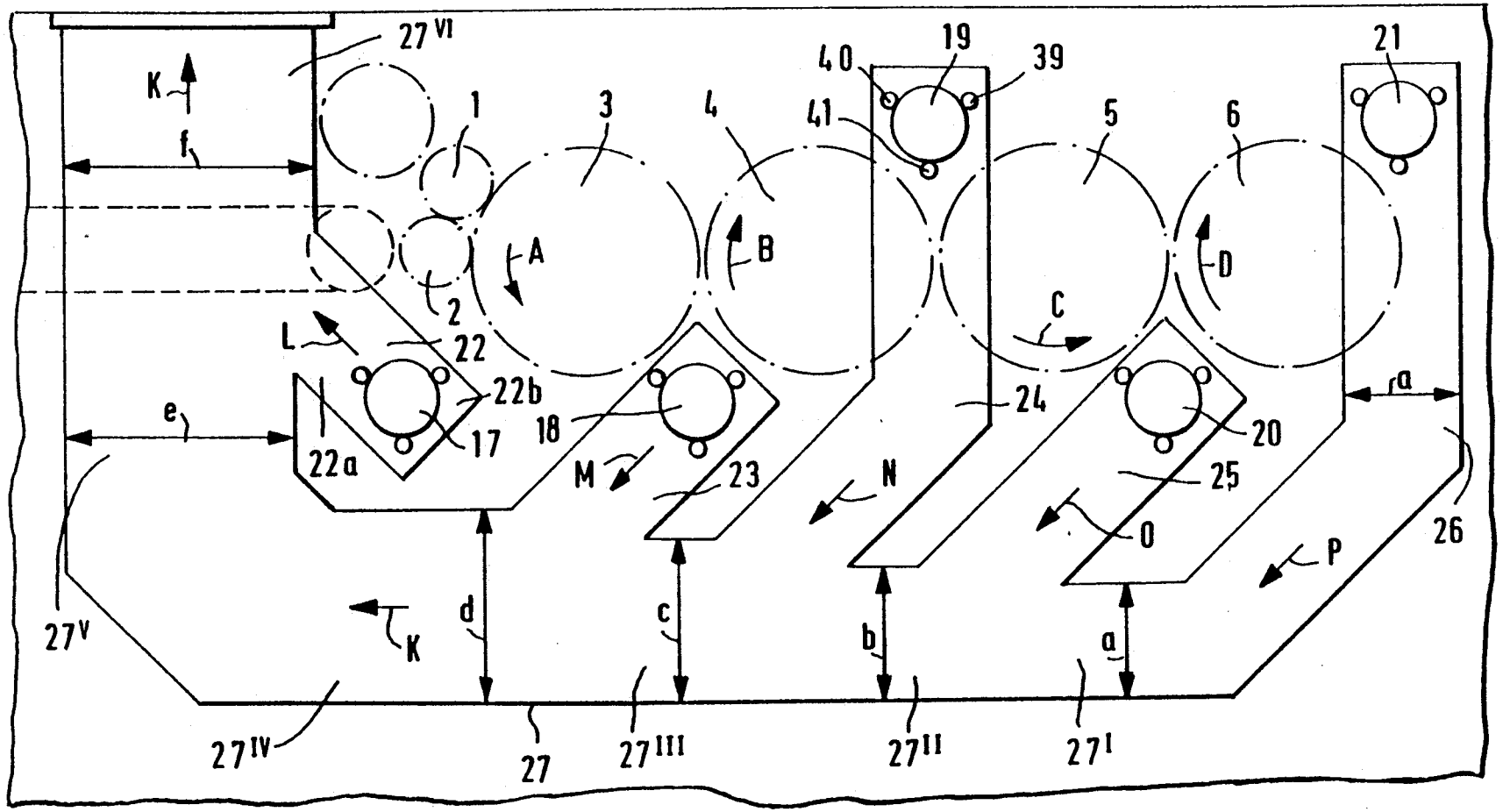
FIG. 1*b* is a schematic side elevational view of a preferred embodiment of the invention.

Turning to FIG. 1*b*, a respective suction conduit 22–26 is coupled to each suction hood 17–21. The suction conduits 22–26 open into a common suction duct 27 which extends along the series of rolls 3, 4, 5 and 6 spaced from and generally parallel to the roll series. The suction conduits 22–26 are of rigid construction and constitute, with the suction duct 27, a one-piece member made, for example, of sheet metal. The length of the suction conduits 22–26 is not uniform, it is determined by the distance between the respective suction hoods 17–21 on the one hand and the suction duct 27 on the other hand. The cross section $27^{I}$–$27^{V}$ of the suction duct 27, as viewed in the flow direction designated by the arrow K, is gradually greater after the merging of consecutive suction conduits 22–26. The end of the suction duct 27 is connected with a non-illustrated vacuum source. The direction of flow within the suction conduits 22–26 is designated by respective arrows L–P.

In the description which follows, the operation of the above-described apparatus will be set forth.

The fiber lap formed of fiber tufts is advanced under a clamping force through the nip of the feed rolls 1 and 2 to the pin roll 3 which combs the fiber material and entrains fiber clusters on the pins. As the fiber material is carried by the roll in front of the waste discharge opening 7 and the mote knife 12, short fibers and coarse impurities are thrown out of the fiber material by centrifugal forces dependent upon the circumferential speed and curvature of the roll 3 as well as the size of the waste discharge opening 7 associated with this first separating stage. Thereafter the waste passes through the waste discharge opening 7 and is admitted to the suction hood 17. The fiber material pre-cleaned in this manner is taken over by the clothing points of the clothed roll 4 from the first roll 3 and is further opened. As the material, carried by the rolls 4, 5 and 6 passes by the waste discharge openings 9, 10 and 11, further impurities are thrown out of the fiber mass by virtue of centrifugal forces. At the end of the last roll 6 an air stream G strips the roll 6 of the cleaned fiber material and conveys the same as a stream H in a suction duct 22. The circumferential speed of the successive rolls is in each instance greater than that of the preceding roll. There are further provided air guide elements 23', 24', 25' and 26' which are secured to the inlet of the suction hoods 17–21 and which are adjustable to set the flow rate of the suction air flow.

Figure 2:
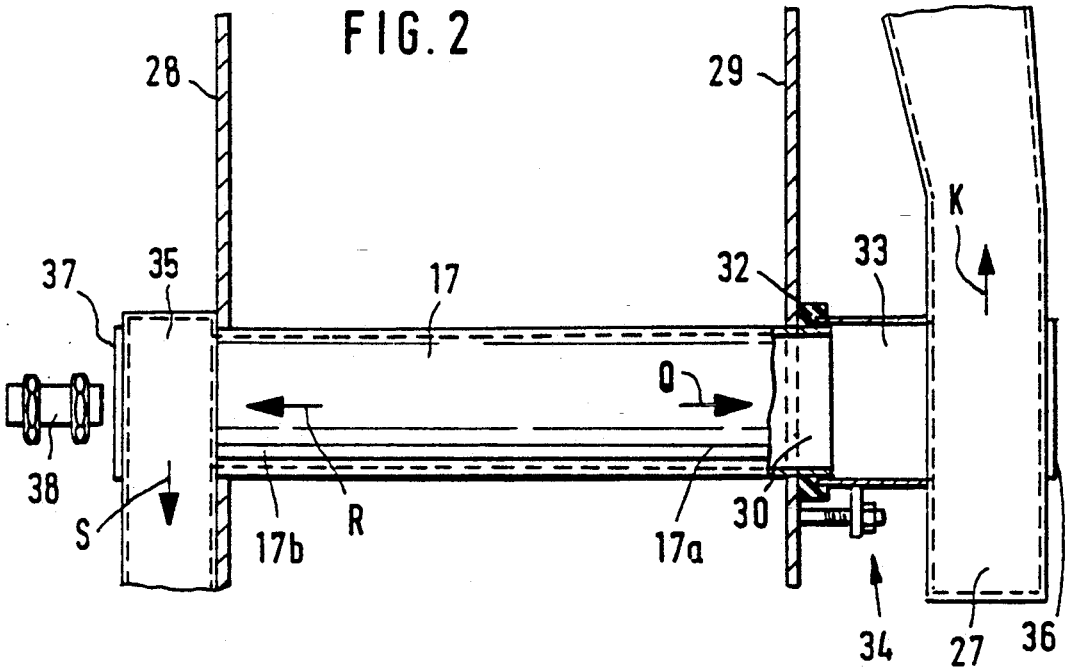
FIG. 2 is a schematic front elevation of the construction shown in FIG. 1*b*.
Figure 3:
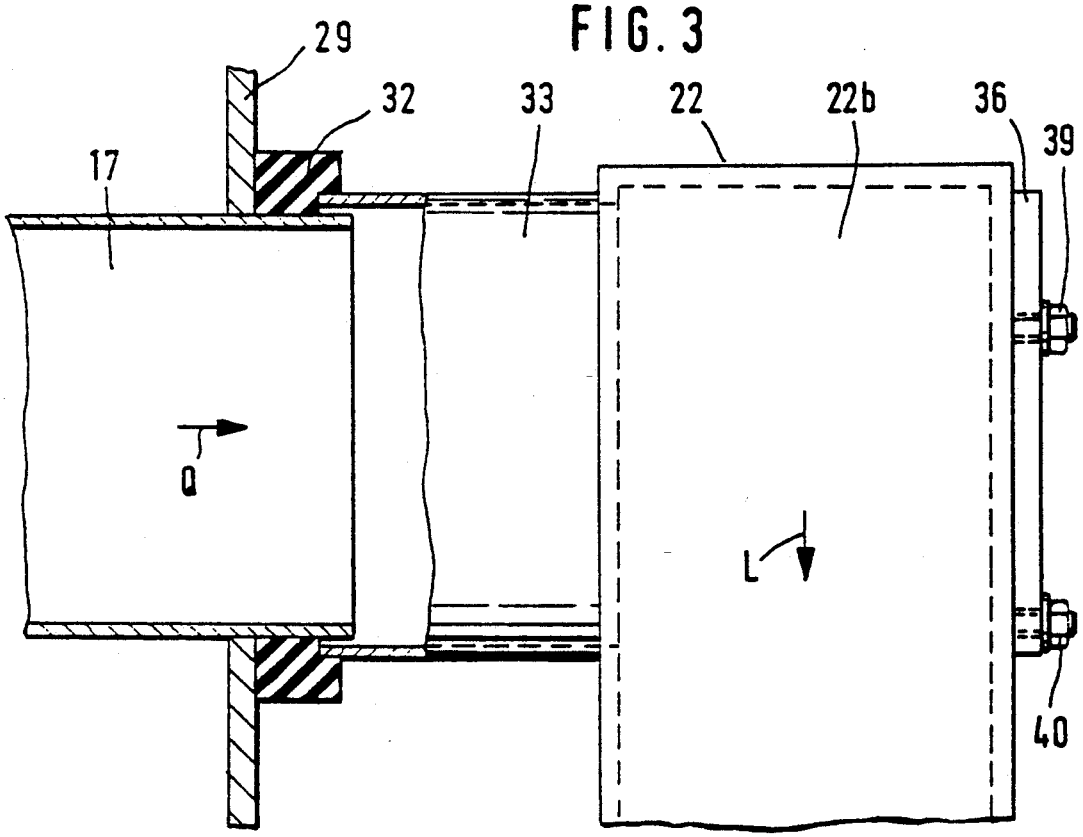
FIG. 3 is a schematic top plan view of a detail of the preferred embodiment illustrated on an enlarged scale.

Turning to FIG. 2, the suction hood 17 is situated between two opposite housing walls 28, 29 and extends therethrough by means of nipples 30 provided at opposite ends 7*a*, 17*b* of the suction hood 17 (only the nipple 30 at the end 17*a* is visible). The nipple 30 is surrounded by an annular elastic seal 32, made, for example, of foam material. The seal 32 at the end 17*a* also surrounds a further coupling nipple 33 which is pulled over the nipple 30 and which perpendicularly joins an end zone 22*b* of the suction conduit 22 as shown in FIG. 3. The other end 22*a* of the suction conduit 22 joins the suction duct 27 as shown in FIG. 1*b*. The coupling nipple 33 is mounted on the housing wall 29 by a securing device, for example, a screw connection designated at 34. The end 17*b* of the suction hood 17 is connected to a suction duct 35 which is coupled to a non-illustrated vacuum source. In this manner the suction hood 17 is exposed to oppositely directed suction streams Q and R at opposite ends 17*a*, 17*b*. At opposite ends 17*a* and 17*b* of the suction hood 17, in the conduit (not shown) that couples the suction hood 17 with the suction duct 35 and in the conduit 22 that couples the suction hood 17 with the suction duct 27, there are provided axially facing respective transparent panels 36, 37 for a visual monitoring from the outside to view the inside of the suction hood 17 and to be able to see through it. The panels 36, 37 are secured to the outside of their respective conduits by an exteriorly accessible screw connection 39, 40 as shown for the panel 36 in FIG. 3. The panel 37 is associated externally of the suction duct 35 with an optical barrier 38 so that upon clogging of the suction hood 17 with fiber material an automatic regulation is feasible. The optical barrier 38 is coupled to a non-illustrated display or indicating device. Arrows Q and R designate the flow direction of the suction streams within the suction hood 17 whereas the arrow S designates the air stream within the suction duct 35.

The additional suction hoods 18–21 are, with associated suction conduits 23–26 and the non-illustrated suction conduits, coupled to the suction ducts 27 and 35 in the same manner as described in connection with the suction hood 17.

Figure 4:
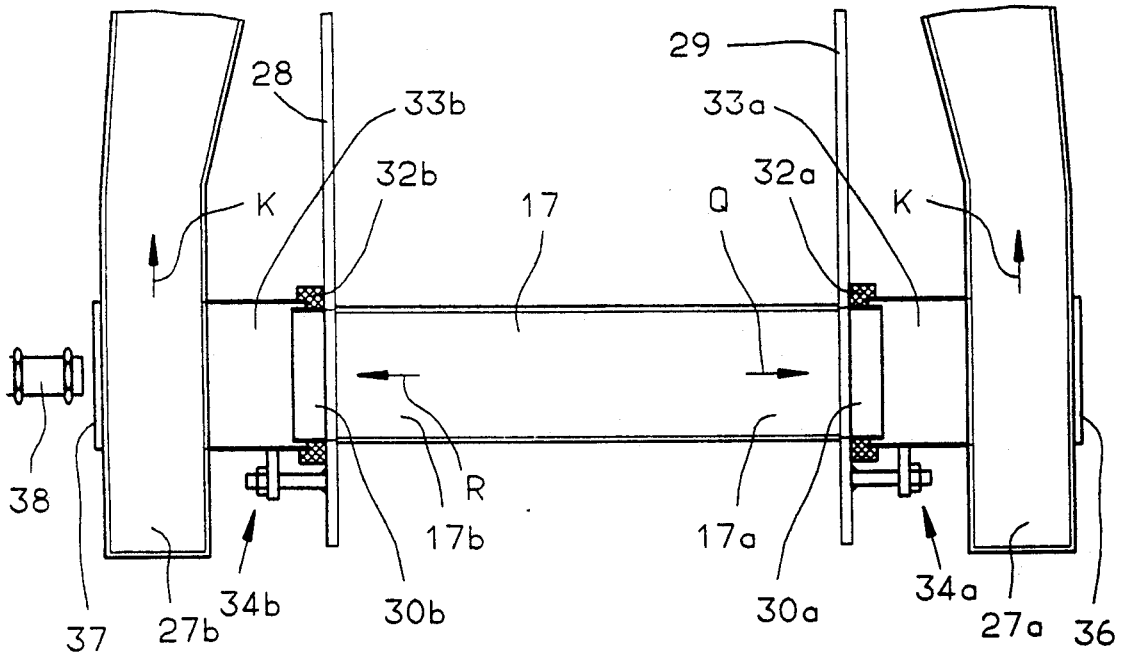
FIG. 4 is a schematic front elevation of a variant of the structure shown in FIG. 2.

According to FIG. 4, at both ends 17*a*, 17*b* of the suction hood 17 there are arranged, in a mirror image, identical coupling nipples 33*a* and 33*b*, respectively, and identical suction ducts 27*a* and 27*b*, respectively.

It will be understood that the above description of the present invention is susceptible to various modifications, changes and adaptations, and the same are intended to be comprehended within the meaning and range of equivalents of the appended claims.

We claim:

1. In a fiber processing machine including clothed rolls for entraining fiber along a circular path, a housing surrounding the rolls; at least two waste discharge openings; a separate mote knife bounding each said waste discharge opening; a suction hood adjoining each waste discharge opening for receiving waste passing through the respective waste discharge opening; a separate suction conduit coupled to respective suction hoods for receiving waste therefrom; and a common suction duct coupled to each suction conduit for receiving the waste therefrom; the improvement wherein said suction conduits and said common suction duct form a one-piece component.

2. A fiber processing machine as defined in claim 1, wherein said suction conduits are of rigid construction.

3. A fiber processing machine as defined in claim 1, wherein said suction conduits have unlike lengths.

4. A fiber processing machine as defined in claim 1, further comprising securing means for disconnectably attaching said suction conduits to the respective suction hoods.

5. In a fiber processing machine including a series of clothed rolls for entraining fiber along a circular path; a housing surrounding the rolls; at least two waste discharge openings adjacent the rolls for passage of waste from the fiber entrained by the rolls; a separate mote knife bounding each said waste discharge opening; a suction hood adjoining each waste discharge opening for receiving waste passing through the respective waste discharge opening; a separate suction conduit coupled to the respective suction hoods for receiving the waste therefrom; and a common suction duct coupled to each suction conduit for receiving waste therefrom; the improvement wherein said common suction duct extends along said series of clothed rolls generally parallel thereto; and further wherein said suction conduits and said common suction ducts form a one-piece component.

6. In a fiber processing machine including clothed rolls for entraining fiber along a circular path; a housing surrounding the rolls; at least two waste discharge openings; a separate mote knife bounding each said waste discharge opening; a suction hood adjoining each waste discharge opening for receiving waste passing through the respective waste discharge opening; a separate suction conduit coupled to respective suction hoods for receiving waste therefrom; and a common suction duct coupled to each suction conduit for receiving the waste therefrom; the improvement wherein said suction conduits and said common suction duct form a one-piece component and further wherein said suction conduits have unlike diameters.

7. In a fiber processing machine including clothed rolls for entraining fiber along a circular path; a housing surrounding the rolls; at least two waste discharge openings; a separate mote knife bounding each said waste discharge opening; a suction hood adjoining each waste discharge opening for receiving waste passing through the respective waste discharge opening; a separate suction conduit coupled to respective suction hoods for receiving waste therefrom; and a common suction duct coupled to each suction conduit for receiving the waste therefrom; the improvement wherein said suction conduits and said common suction duct form a one-piece component and further wherein said suction conduits merge into said common suction duct with respective outlet ends along a length portion of said suction duct; said common suction duct having an increase in diameter downstream of each said outlet end of the respective suction ducts as viewed in a direction of waste flow in said common suction duct.

8. In a fiber processing machine including clothed rolls for entraining fiber along a circular path; a housing surrounding the rolls; at least two waste discharge openings; a separate mote knife bounding each said waste discharge opening; a suction hood adjoining each waste discharge opening for receiving waste passing through the respective waste discharge opening; a separate suction conduit coupled to respective suction hoods for receiving waste therefrom; and a common suction duct coupled to each suction conduit for receiving the waste therefrom; the improvement wherein said suction conduits and said common suction duct form a one-piece component and the improvement further comprising a separate, adjustable air guide element mounted on each said suction hood.

9. In a fiber processing machine including clothed rolls for entraining fiber along a circular path; a housing surrounding the rolls; at least two waste discharge openings; a separate mote knife bounding each said waste discharge opening; a suction hood adjoining each waste discharge opening for receiving waste passing through the respective waste discharge opening; a separate first suction conduit coupled to respective suction hoods for receiving waste therefrom; and a first common suction duct coupled to each first suction conduit for receiving the waste therefrom; the improvement wherein said first suction conduits and said first common suction duct form a one-piece component; further wherein each said suction hood has opposite first and second ends; said first suction conduits being coupled to said first ends; the improvement further comprising second suction conduits coupled to the second ends of said suction hoods and a second common suction duct coupled to each said second suction conduit, whereby each said suction hood is bilaterally exposed to vacuum; said second suction conduits and said second common suction duct forming a one-piece component.

10. In a fiber processing machine including clothed rolls for entraining fiber along a circular path; a housing surrounding the rolls; at least two waste discharge openings; a separate mote knife bounding each said waste discharge opening; a suction hood adjoining each waste discharge opening for receiving waste passing through the respective waste discharge opening; a separate suction conduit coupled to respective suction hoods for receiving waste therefrom; and a common suction duct coupled to each suction conduit for receiving the waste therefrom; the improvement wherein said suction conduits and said common suction duct form a one-piece component; the improvement further comprising securing means for disconnectably attaching said suction conduits to the respective suction hoods; and an elastic seal between each said suction conduit and the suction hood associated therewith.

11. A fiber processing machine as defined in claim 10, wherein said elastic seal is a rubber-elastic seal.

12. In a fiber processing machine including clothed rolls for entraining fiber along a circular path; a housing surrounding the rolls; at least two waste discharge openings; a separate mote knife bounding each said waste discharge opening; a suction hood adjoining each waste discharge opening for receiving waste passing through the respective waste discharge opening; a separate suction conduit coupled to respective suction hoods for receiving waste therefrom; and a common suction duct coupled to each suction conduit for receiving the waste therefrom; the improvement wherein said suction conduits and said common suction duct form a one-piece component; the improvement further comprising a transparent window provided in said one-piece component.

13. A fiber processing machine as defined in claim 12, further comprising exteriorly accessible means for removably mounting said transparent window on said one-piece component.

14. A fiber processing machine as defined in claim 12, wherein said transparent window is provided in one of said suction conduits.

15. A fiber processing machine as defined in claim 14, wherein said one suction conduit has two transparent windows generally in alignment with one another and situated on opposite wall portions of said one suction conduit.

16. A fiber processing machine as defined in claim 15, further comprising an optical barrier means positioned in alignment with a light path interconnecting said transparent windows for emitting a signal upon interruption of light along said light path.

* * * * *